US005910398A

United States Patent [19]

Schmidt et al.

[11] Patent Number: 5,910,398

[45] Date of Patent: Jun. 8, 1999

[54] PHOTOGRAPHIC GLASS PLATES HAVING ANTIHALATION UNDERLAYER

[75] Inventors: Ronald James Schmidt; Lawrence Annello Savino, both of Rochester, N.Y.

[73] Assignee: Eastman Kodak Company, Rochester, N.Y.

[21] Appl. No.: 08/662,575

[22] Filed: Jun. 13, 1996

[51] Int. Cl.[6] ..... G03C 1/76

[52] U.S. Cl. ..... 430/510; 430/517; 430/523; 430/935; 430/950; 427/407.2

[58] Field of Search ..... 430/510, 517, 430/523, 950, 935; 427/407.2

[56] References Cited

U.S. PATENT DOCUMENTS

| | | | |
|---|---|---|---|
| 4,168,168 | 9/1979 | Sato . | |
| 4,891,296 | 1/1990 | Tsurukiri et al. | 430/142 |
| 5,238,798 | 8/1993 | Usami | 430/522 |
| 5,254,447 | 10/1993 | Meyer et al. | 430/510 |

*Primary Examiner*—Thorl Chea
*Attorney, Agent, or Firm*—J. Lanny Tucker

[57] ABSTRACT

Photographic glass plates can be prepared by directly coating the appropriate layer formations onto a glass support. One element comprises a thin subbing layer (less than 2 $\mu$m), an antihalation layer, a silver halide emulsion layer, and a protective overcoat layer that can also include a matting agent or lubricant. Another embodiment has the antihalation layer coated directly onto the support.

5 Claims, 1 Drawing Sheet

PHOTOGRAPHIC GLASS PLATES HAVING ANTIHALATION UNDERLAYER

FIELD OF THE INVENTION

This invention relates in general to photography, and in particular to photographic glass plates having an antihalation underlayer.

BACKGROUND OF THE INVENTION

Photographic elements are coated on a wide variety of support materials, such as plastic resins, paper and glass. Plastics are used as the support when a combination of transparency, strength, dimensional stability and light weight is needed. Paper is used when the physical properties are not too demanding, cost is a major factor or an opaque base is needed. Glass has the advantages of excellent dimensional stability and extreme flatness, but is disadvantageous in that it is expensive, heavy and brittle. Photographic glass supports typically range in thickness from about 1 to 10 millimeters and are graded by flatness. Those with the lowest degree of flatness are used in such applications as photomicrography and graphic arts, those with an intermediate degree of flatness are used in such applications as photofabrication, stereoplotters and aerial photography, and those with the highest degree of flatness are used in such applications as high-precision stereoplotters, ballistic and aerotriangulation camera systems and special scientific investigations.

The coating of glass plates with photographic layers is a very demanding art since the layers must be extremely thin, highly uniform in thickness, and completely free from defects. One technique for coating such layers based on wicking action using an arcuate surface is described in U.S. Pat. No. 4,033,290 (Dude). There are many difficulties in coating glass substrates, including the likelihood of "skips" that result in uncoated areas, the difficulty in coating extremely thin layers, and the presence of streaks and contaminants such as dust. There is a continuing need to reduce or eliminate these problems.

One attempt at this is described in U.S. Pat. No. 5,254,447 (Meyer et al) in which various layers are applied to glass plates by lamination techniques. Such techniques solve certain problems such as protection of the photosensitive layers, and other features described in the noted patent. Moreover, these techniques allow for the production of multilayer plates that were difficult to prepare using previously known coating techniques.

However, lamination of various layers to provide photographic glass plates has a number of disadvantages. Dirt entrapped between laminated layers can become prominent in the resulting element causing undesirable non-uniformities, sometimes called "tentpoles". In certain elements, protective overcoats are desired, but when matting agents are included in such overcoat layers, they cannot protrude because this layer rests on a film support prior to the lamination process. This renders the matting agent ineffective. In order to be effective, it is necessary that the matting agent protrude from the overcoat surface to provide excellent vacuum drawdown and reduced tackiness. Moreover, lubricants cannot readily be put into the protective overcoat layers using the prior art process because the lubricants decrease adhesion of the layers to the polymer films required in lamination procedures.

It would be desirable to provide photographic glass plates that contain antihalation layers beneath the photographic layer, over which is a protective overcoat that can contain a matting agent or lubricant. Such elements cannot be readily prepared by lamination techniques.

SUMMARY OF THE INVENTION

The problems described above are overcome with photographic element comprising a glass support having hereon, in order:

a subbing layer having a dry thickness of less than 2 $\mu$m, an antihalation layer, a silver halide emulsion layer, and a protective overcoat layer.

This invention also provides a photographic element comprising a glass support having thereon, in order, only the following layers:

an antihalation layer, a silver halide emulsion layer, and a protective overcoat layer comprising a matting agent or lubricant.

The photographic elements of this invention are advantageously prepared using coating techniques rather than lamination techniques. Thus, the problems noted above with lamination, such as entrapped dirt causing non-uniformities, ineffectiveness of matting agent and the inability to use lubricants in the protective overcoat layers are avoided with this invention. The elements of this invention have an antihalation layer between the glass support and photographic layer to reduce light backscatter, light "piping" from edges of the glass support, and unwanted image distortion from manufacturing non-uniformities within the glass supports. Moreover, the application of antihalation layers on the backside of the glass support can be avoided. Such backside layers are generally coated out of objectionable organic solvents and render the resulting plates difficult to process. The backside layers are also subject to abrasion during the manufacturing process. This invention avoids these problems.

In preferred embodiments, the elements of this invention also have a very thin subbing layer to adhere the antihalation layer to the glass support. The subbing layers are not conventional pressure-sensitive or heat-curable adhesive layers that are required to prepare elements using lamination techniques. Alternatively, the antihalation layers can be coated directly on the glass supports, with additives to promote adhesion to the supports. In all embodiments, the protective overcoat layer can contain either a lubricant or matting agent, and preferably both.

DETAILED DESCRIPTION OF THE INVENTION

Figure 1:
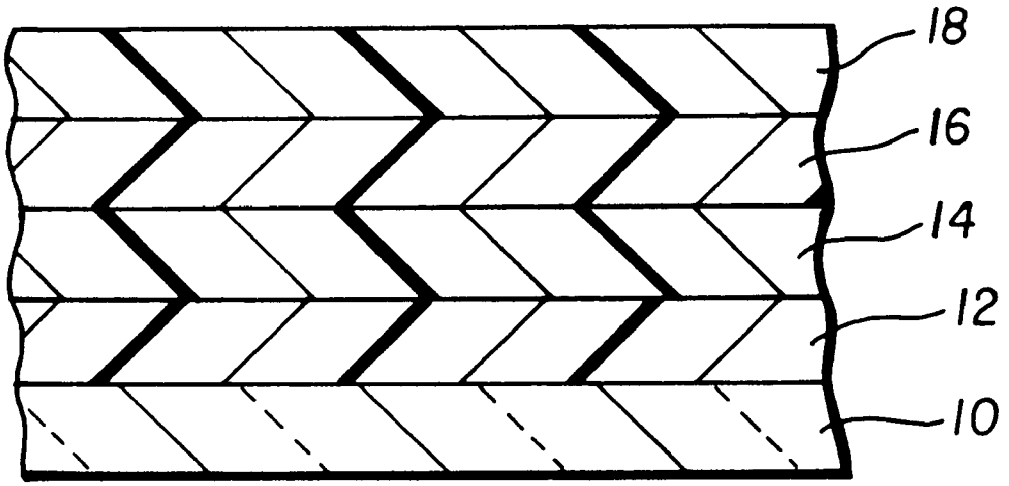
FIG. 1 is a cross-sectional view of one embodiment of this invention wherein the photographic element comprises a thin subbing layer between the glass support and the antihalation layer.

Common to all embodiments of the present invention is a glass plate that provides a rigid and highly dimensionally stable support upon which all of the element layers are disposed. Any suitable glass plate can be used having the desired degree of flatness and clarity. Preferably, the glass plate has a high degree of flatness. Generally, the glass support has a thickness of at least about 0.5 mm, and preferably it has a thickness of from about 1 to about 10 mm. The resulting elements can have any suitable dimensions, and include the large format photographic plates that have a major dimension greater than about 75 cm.

In a preferred embodiment of this invention, a subbing layer is disposed on the glass support to adhere the other layers of the element. Generally, such subbing layers are film-forming hydrophilic colloidal materials or hydrophilic polymer binders that are well known in the photographic art, but which are not used specifically for antistatic or antihalation purposes. Such materials must adequately adhere the upper layers to the glass support, and be essentially transparent to radiation of the wavelength used in exposing the photographic element. Moreover, it should be resistant to any processing solutions that would penetrate the overlying layers or contact the subbing layer at its edges. Typical subbing layer materials include, but are not limited to, gelatin and other film-forming colloidal materials, vinylidene chloride polymers [such as poly(vinylidene chloride-co-methyl acrylate-co-itaconic acid), and poly (acrylonitrile-co-vinylidene chloride-co-acrylic acid)] and other materials readily apparent to one skilled in the art. Various subbing materials are described, for example, in U.S. Pat. No. 4,415,626 (Hasenauer et al) and the Alles et al, Nadeau et al and Khanna et al patents mentioned therein. More than one subbing layer can be used as long as the total dry thickness of the one or more subbing layers is less than 2 $\mu$m, preferably from about 0.02 to about 1 $\mu$m, and most preferably, from about 0.02 to about 0.2 $\mu$m.

The subbing layers used in the invention are not considered adhesives as described in U.S. Pat. No. 5,254,447 (noted above). Thus, the subbing layers of this invention are not considered to be the conventional heat-curable or pressure-sensitive adhesives that are required for the lamination of various layers to form multilayer photographic glass plates. Moreover, they are much thinner than the adhesive layers described in the noted patent.

Photographic glass plates of the art typically have an antihalation layer on the side of the glass support opposite that on which the silver halide emulsion layer is coated (that is, on the backside of the glass support). The plates of this invention, however, differ in that the antihalation layer is on the same side as the silver halide emulsion layer. Of course, U.S. Pat. No. 5,254,447 (noted above) shows the antihalation layer and silver halide emulsion layer on the same side in the elements, but there is no thin subbing layer used in those elements.

The antihalation layers used in the invention generally comprise one or more dyes or pigments dispersed in one or more film-forming binders, such as gelatin and other materials known in the photographic art for that purpose. These layers function to prevent light from being reflected into the overlying silver halide emulsion layer(s) thereby avoiding an undesired spreading of the image that is known in the art as "halation". The layers also may comprise one or more surfactants that are useful as coating aids.

Suitable binder materials useful in such layers include, but are not limited to, naturally occurring hydrophilic colloids such as gelatin or gelatin derivatives, cellulose derivatives, polysaccharides such as dextran, zein, casein, pectin, collagen derivatives and other materials known in the art for this purpose, including synthetic polymeric binder materials.

Dyes that are useful in the antihalation layer can be essentially any dye that is useful as a photographic filter dye, including, but not limited to, oxonols, cyanines, merocyanines, arylidenes and others known in the art for this purpose. The filter dyes may be diffusible or non-diffusible, but are preferably solublizable during photographic processing. Various classes of useful dyes are described in U.S. Pat. No. 5,254,447 (noted above), and the references cited therein. Basically one or more filter dyes are selected to cover a suitable range of spectral sensitivity for the photographic plate, whether that sensitivity be in the visible, infrared or ultraviolet regions (or combinations thereof) of the electromagnetic spectrum.

Alternatively and preferably, the filter dyes are solid particle dispersion filter dyes, as described in Cols. 14 and 15 of U.S. Pat. No. 5,254,447 (noted above) and the references cited therein.

A mixture of filter dyes can be used in the antihalation layer. Moreover, more than one antihalation layer can be used with the same or different dyes, as long as the total dry thickness of the one or more antihalation layers is from about 0.5 to about 5 $\mu$m, and preferably, from about 1 to about 3 $\mu$m.

The photographic elements of this invention can be black-and-white elements (of various spectral sensitivities), color elements adapted for use in a negative-positive process, or color elements adapted for use in a reversal process. They can include one or more photographic silver halide emulsion layers over the antihalation layer(s), each of which can include any of the photographically useful silver halides, binders or vehicles, and other addenda commonly used in such emulsions. Thus, useful silver halides include, but are not limited to silver chloride, silver bromide, silver iodobromide, silver iodochloride, silver iodobromochloride, silver bromochloride, silver chlorobromide and the like (the halides being named in ascending order of molar amount based on total halides). Other details of useful photographic silver halide emulsions are provided in *Research Disclosure*, publication 36544, pages 501–541 (September 1994). *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). The binder materials described above for the antihalation layer can also be used in the silver halide emulsion layer.

As noted above, one or more silver halide emulsion layers can be used, although preferred embodiments include only a single emulsion layer. The dry thickness of the emulsion layer(s) used in the elements is generally from about 1 to about 10 $\mu$m, and preferably from about 2 to about 5 $\mu$m.

As indicated above, the photographic element also comprises a protective overcoat layer. The function of this layer is to provide protection against abrasion, scratching, fingerprints and the like. The protective overcoat layer is generally comprised of gelatin or another suitable hydrophilic colloid or polymeric material and typically contains other components such as one or more surfactants and/or filter dyes (as described above for the antihalation layer).

Preferably, the protective overcoat layer also includes a matting agent that can be of either an organic or inorganic material. Examples of organic matting agents are polymeric particles or beads. Examples of inorganic matting agents include, but are not limited to, particles of silicon dioxide, titanium dioxide, magnesium oxide, aluminum oxide, barium sulfate, calcium carbonate and others known in the art. The desired dimensions of such matting agents can vary, and generally they are present in an amount of at least about 0.005 g/m$^2$ and preferably at from about 0.01 to about 0.1 g/m$^2$. The level of matting agent is chosen to assure that a sufficient number of matting agent particles protrude from the outer surface of the protective overcoat layer, giving it a roughened surface. This provides desired vacuum drawdown and reduced surface tackiness. A preferred matting agent is silicon dioxide.

Alternatively or in addition to the matting agent, it is preferred that the protective overcoat layer includes one or more lubricants. Such materials provide ease of handling and protection from abrasion and fingerprints. Useful lubricants include those that are low in haze and typically used in the manufacture and finishing of photographic films, plates and papers.

Useful lubricants that can be used singly or in combination include, but are not limited to, silicone oils or waxes (including silicone oil, silicones having polar groups, fatty acid-modified silicones, and fluorine-containing silicones), fluorine-containing alcohols, fluorine-containing esters or ethers, fluorinated polyalkanes, polyolefins, polyglycol alkyl phosphates or alkali metal salts thereof, polyphenyl ethers, fluorine-containing alkylsulfates or alkali metal salts thereof, monobasic fatty acids having 10 to 24 carbon atoms (branched or linear, saturated or unsaturated) or metal (alkali metals or copper) salts thereof, mono- or polyvalent alcohols having 12 to 22 carbon atoms (branched or linear, saturated or unsaturated), alkoxy alcohols having 12 to 22 carbon atoms, mono-, di or triesters of monobasic fatty acids having 10 to 24 carbon atoms (branched or linear, saturated or unsaturated), fatty acid esters of monoalkyl ethers of alkylene oxide polymers, fatty acid amides having 8 to 22 carbon atoms (branched or linear, unsaturated or saturated) or aliphatic amines having 8 to 22 carbon atoms (branched or linear, unsaturated or saturated, and optionally interrupted by one or more carbonyl, oxy, amino, thio, carbonyoxy, oxycarbonyl or carbonamide groups). Mixtures of compounds within any group noted above, or mixtures of compounds from two or more groups are also useful. Mixtures are likely since many of these materials are commercially available as such.

Specific examples of useful lubricants include, but are not limited to, lauric acid, myristic acid, palmitic acid, stearic acid, behenic acid, butyl stearate, oleic acid, linolic acid, linolenic acid, elaidic acid, octyl stearate, amyl stearate, isooctyl stearate, octyl myristate, butoxyethyl stearate, anhydrosorbitan monostearate, anhydrosorbitan distearate, anhydrosorbitan tistearate, pentaerythrityl tetrastearate, oleyl alcohol and lauryl alcohol, and mixtures thereof.

A more preferred lubricant comprises alcohol esters of methyl myristate, methyl palmitate or methyl stearate, or mixtures thereof.

The protective overcoat layer of the elements generally has a dry thickness of at least about 0.5 $\mu$m, and more particularly a dry thickness of from about 1 to about 4 $\mu$m, and more preferably a dry thickness of from about 2 to about 3 $\mu$m.

The layers of the elements can be coated on the glass support using any suitable conventional coating technique and coating equipment, including wick application, gravure, slide hopper, X-hopper and other techniques known in the art. The coating conditions and solvents for each layer would be readily apparent to one skilled in the photographic art. Thus, the various embodiments of this invention can be prepared by coating the appropriate layer formulations, in order, onto the glass support. Preferably, those layers are coated using the same multilayer coating machine in one pass.

The elements of this invention can include other layers not specifically defined herein, such as conventional interlayers or filter layers. Layers can be on the backside of the glass support if desired, but preferably the glass support is free of layers on the backside.

Referring to FIG. 1, a preferred embodiment of this invention includes glass support 10 on which is disposed thin subbing layer 12, antihalation layer 14, silver halide emulsion layer 16, and protective overcoat layer 18.

Figure 2:
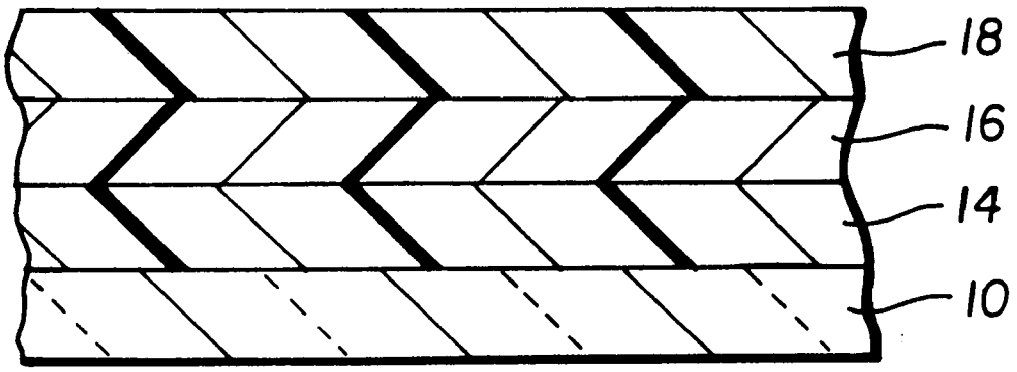
FIG. 2 is cross-sectional view of a second embodiment of this invention wherein the photographic element has an antihalation layer bonded directly to the glass support.

A second embodiment, illustrated in FIG. 2, includes glass support 10 on which is directly coated antihalation layer 14, silver halide emulsion layer 16 and protective overcoat layer 18.

The following example is intended to illustrate the invention but not to limit it in any way. The coating coverages are in g/m$^2$ unless otherwise indicated.

EXAMPLE

Preferred Photographic Glass Plate

A preferred element of this invention was prepared by coating the following layer formulations, in order, on a conventional glass plate support using a conventional multilayer coating machine:

(a) a subbing layer formulation comprising gelatin binder material in water/alcohol mixture to provide a dry thickness of 0.05 $\mu$m;

(b) an antihalation layer formulation comprising a conventional UV and blue-light absorbing filter dyes (0.03), in gelatin to provide a dry thickness of 1 $\mu$m;

(c) a silver halide emulsion layer formulation comprising a black and white silver chloride emulsion to provide a dry thickness of 5 $\mu$m; and (d) a protective layer overcoat formulation comprising silicon dioxide matting agent (0.03 g/m$^2$) in gelatin binder material to provide a dry thickness of 3 $\mu$m.

The glass plate support was 4.7 mm thick.

The invention has been described in detail with particular reference to preferred embodiments thereof, but it will be understood that variations and modifications can be effected within the spirit and scope of the invention.

We claim:

1. A method of preparing a photographic element comprising coating on a glass support, the following formulations, in order, to form coated layers on said glass support:

a subbing layer formulation in an amount sufficient to provide a coated subbing layer having a dry thickness of from about 0.02 to about 2 $\mu$m, an antihalation layer formulation to provide a coated antihalation layer having a thickness of from 1 to about 5 $\mu$m, a silver halide emulsion to provide a coated silver halide emulsion layer, and a protective overcoat layer formulation comprising a matting agent at a level of from about 0.005 to about 0.1 g/m$^2$, and a lubricant, to provide a protective overcoat layer having a thickness of from 1 to about 4 $\mu$m, said element lacking backside layers on said glass support, and said method being carried out without lamination, and said formulations being coated on said glass support using a multilayer coating machine.

2. The method of claim 1 wherein said subbing layer is composed of gelatin or a vinylidene chloride polymer, has a dry thickness of from about 0.02 to about 0.2 μm.

3. The method of claim 1 wherein said antihalation layer comprises a particulate filter dye in a binder material.

4. The method of claim 1 wherein said matting agent is a polymeric particle, or a silicon dioxide, titanium dioxide, magnesium oxide, aluminum oxide, barium sulfate or calcium carbonate particle.

5. The method of claim 1 wherein said glass support has a thickness of from about 1 to about 10 mm, said subbing layer has a dry thickness of from about 0.02 to about 1 μm, said antihalation layer has a dry thickness of from about 1 about 3 μm, said silver halide emulsion layer has a dry thickness of from about 2 to about 3 μm.

* * * * *